United States Patent [19]

Morioka

[11] Patent Number: 4,771,552

[45] Date of Patent: Sep. 20, 1988

[54] HOT AIR DRYING SYSTEM FOR AUTOMOBILE BODIES

[75] Inventor: Koji Morioka, Amagasaki, Japan

[73] Assignee: Taikisha, Ltd., Tokyo, Japan

[21] Appl. No.: 69,825

[22] Filed: Jul. 6, 1987

[30] Foreign Application Priority Data

Jul. 7, 1986 [JP] Japan ..... 61-159219

[51] Int. Cl.[4] ..... F26B 15/12

[52] U.S. Cl. ..... 34/222; 34/225; 34/229; 34/243 C

[58] Field of Search ..... 34/243 C, 243 R, 222, 34/229, 233, 225; 15/DIG. 2, DIG. 7

[56] References Cited

U.S. PATENT DOCUMENTS 3,451,094 6/1969 Kywi ..... 34/243 C 3,805,410 4/1974 Rupp ..... 34/229

3,808,698 5/1974 Peters ..... 34/229

4,335,526 6/1982 Smith ..... 34/243 C

*Primary Examiner*—Larry I. Schwartz

*Attorney, Agent, or Firm*—Webb, Burden, Ziesenheim & Webb

[57] ABSTRACT

A hot air drying system for drying automobile bodies, comprising a drying chamber including a transport device for transporting the automobile bodies having closed bottoms, and a hot air supplying device for supplying hot air into the drying chamber to heat and dry paint applied to the automobile bodies transported by the transport device. The hot air supplying device includes hot air delivery nozzles for directing the hot air toward inside surfaces of the automobile bodies through openings of the automobile bodies.

17 Claims, 3 Drawing Sheets

HOT AIR DRYING SYSTEM FOR AUTOMOBILE BODIES

BACKGROUND OF THE INVENTION (1) Field of the Invention

The present invention relates to a drying system for heating and drying paint applied to automobile bodies in an automobile body painting process. More particularly, the invention relates to a drying system for drying automobile bodies comprising a drying chamber including a device for transporting automobile bodies having closed bottoms, and a device for supplying hot air for heating and drying paint applied to the automobile bodies in the drying chamber.

(2) Description of the Prior Art

FIG. 5 of the accompanying drawings illustrates a known drying system of the type noted above. As seen, a hot air supplying device 3 includes outlet openings 3*a* for delivering hot air sent through feed ducts 3A into lower regions of a drying chamber 1, and suction openings 3*b* for withdrawing the hot air from upper regions of the drying chamber 1. In this system, therefore, the hot air supplied contacts outside surfaces of an automobile body while flowing upwardly through the drying chamber 1. More particularly, the known drying system is constructed to directly heat and dry paint applied to the outside surfaces of the automobile body by causing the hot air to contact the paint while paint applied to inside surfaces of the automobile body is heated and dried by heat conducted from the outside surfaces through the automobile body and by hot air entering by way of openings such as windows into contact with the inside surfaces. Number 2 in FIG. 5 indicates a carriage for supporting the automobile body. In order to recirculate the hot air for repeated use, the illustrated hot air supplying device 3 further includes a duct 3B for guiding the hot air withdrawn through the suction openings 3*b* to a fan 3C and a burner or other type of heater 3D.

In the case of an automobile body of Monocoque construction, however, a cabin and trunkroom have their bottoms closed by a floor panel of the automobile body. Such a closed construction includes only small bores or the like in certain parts thereof. Therefore, the floor panel impedes good drying of the paint where, as in the prior art, hot air is delivered only to lower regions of the drying chamber. In other words, interior portions of the automobile body under which the floor panel extends have little chance of exposure to the hot air entering from below. Such portions rely solely on the thermal conduction through the automobile body for heating since their contact with the hot air cannot be much expected. Furthermore, these interior portions, after the automobile body has been carried into the drying chamber, retain cool air similar in temperature to air outside the drying chamber. This cool air tends to stagnate in the interior portions, causing so much delay for these portions to reach a chamber temperature. Consequently, the inside surfaces below the windows, such as inside surfaces of the floor panel and lower side panels, tend to be insufficiently heated compared with their outside surfaces. If heat drying of the outside surfaces is used as reference for removal of the automobile body from the drying chamber, the above-noted interior portions closed by the floor panel below will emerge half dry, namely short of tempering. Conversely, if heat is applied until those interior portions become dry to a satisfactory degree, then the outside surfaces and other portions in direct contact with the hot air will become overheated which is unacceptable. This tendency is conspicuous where the automobile body has an increased strength for reinforcement and is difficult to heat by thermal conduction.

Thus, the conventional hot air drying system has encountered great difficulties in drying both outside and inside surfaces of automobile bodies in an optimal manner.

SUMMARY OF THE INVENTION

The object of the present invention is to eliminate the disadvantage of the prior art noted above, and to provide a drying system capable of drying both outside and inside surfaces of automobile bodies in an optimal manner. In addition, the invention intends to provide a drying system capable of drying both outside and inside surfaces of automobile bodies easily and positively without necessitating a complicated construction.

In order to achieve the above object, a hot air drying system for drying automobile bodies according to the present invention comprises a drying apparatus including transport means for transporting the automobile bodies having closed bottoms, and hot air supplying means for supplying hot air into the drying apparatus to heat and dry paint applied to the automobile bodies transported by the transport means, wherein the hot air supplying means includes hot air delivery means for directing the hot air toward inside surfaces of the automobile bodies through openings of the automobile bodies.

The hot air drying system of this invention produces the following functional effect:

Since the hot air supplying means includes hot air delivery means for drying automobile body interiors, sufficient heating and drying are effected not only by the hot air supplied to lower regions of the drying chamber but also by the hot air delivered to lower interior portions of each automobile body which are closed by a floor panel or a carriage stopping entry of the hot air from below. That is, the hot air is delivered into the automobile body, which has the effect of quickly expelling the cool air from inside the automobile body and raising the interior temperature of the automobile body through contact therewith. As a result, inside surfaces of the automobile body are heated through contact with the hot air in addition to the effect of thermal conduction from outside surfaces through the automobile body. The hot air may be delivered at an increased rate after the interior temperature of the automobile body is raised, which expedites the drying process by removing, through evaporation, a solvent from layers of paint on the inside surfaces of the automobile body. Moreover, the hot air is delivered by the hot air delivery means toward the lower portions of the automobile body interior through openings such as the windows which are intrinsic parts of the automobile body. This dispenses with the need for a special contrivance to deliver the hot air. Furthermore, the openings such as the windows are relatively large and provide a freedom for the directions of hot air delivery. This permits the hot air positively to reach deep parts of the automobile body such as corners between the floor panel and side panels, whereby the inside surfaces as well as the outside surfaces of the automobile body are dried in an optimal manner.

Other advantages of the invention will be apparent from the following description of the preferred embodiments.

BRIEF DESCRIPTION OF THE DRAWINGS

FIGS. 1 through 3 show a hot air drying system for drying automobile bodies embodying the present invention, in which:

FIG. 1 is a schematic front view in vertical section of an automobile body showing how hot air is delivered from hot air supply means into the automobile body, FIG. 2 is a plan view showing an arrangement of automobile bodies and the hot air supply means in a drying chamber, and FIG. 3 is a front view in vertical section showing the arrangement of an automobile body in the drying chamber and the hot air supply means.

DETAILED DESCRIPTION OF THE PREFERRED EMBODIMENT

An embodiment of this invention will particularly be described hereinafter with reference to the drawings.

Figure 2:
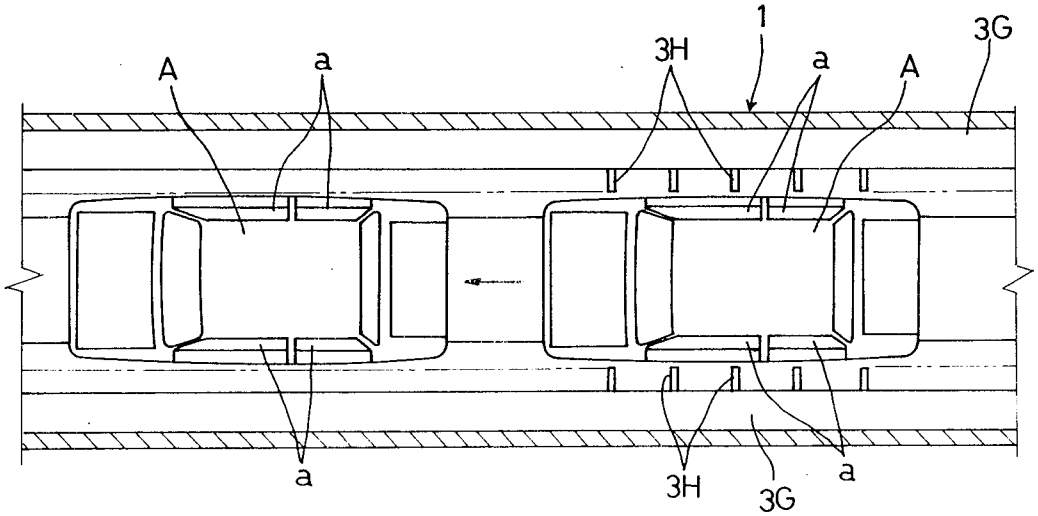
Figure 3:
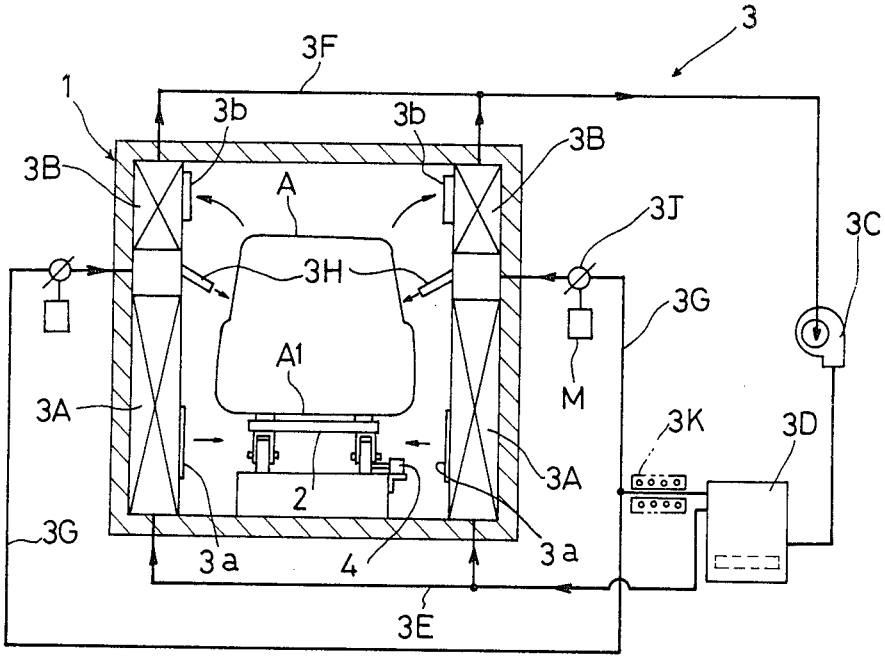
Figure 6:
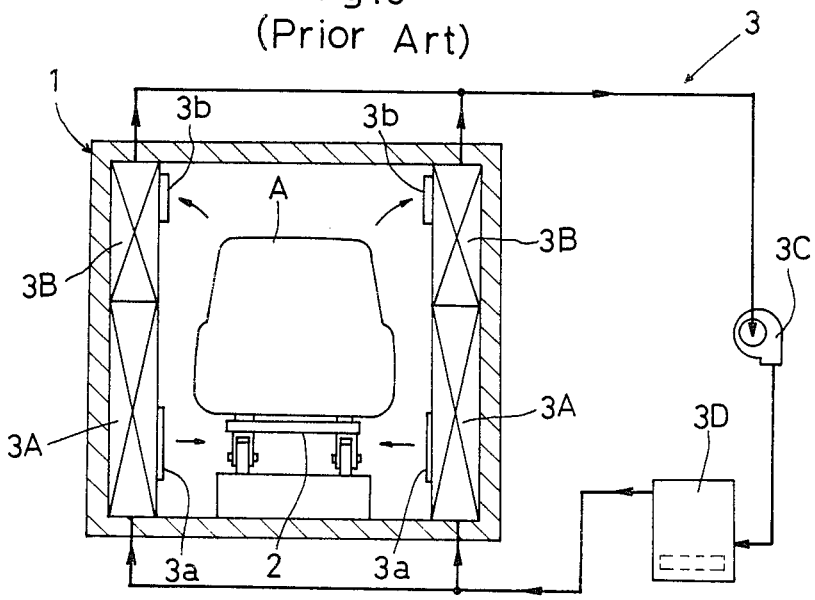
Fig. 6 (Prior Art)
FIG. 6 is a front view in vertical section of a known hot air drying system for drying automobile bodies.

Referring to FIGS. 2 and 3 first, the hot air drying system shown therein comprises a tunnel-like drying chamber 1 acting as drying apparatus and carriages 2 which are one example of transport means for supporting automobile bodies A and transporting them through the drying chamber 1 at a fixed speed. The drying system further comprises a hot air supplying device 3 for supplying hot air to heat and dry paint applied to outside and inside surfaces of the automobile bodies A supported and transported through the drying chamber 1 by the carriages 2.

The hot air supplying device 3 includes lower feed ducts 3A disposed at lower positions of the drying chamber 1 and upper return ducts 3B disposed at upper positions thereof. The feed ducts 3A forming a first hot air means, include a plurality of hot air outlet openings *3a* arranged in a direction of carriage movement, namely longitudinally of the drying chamber 1, and along both lateral side of a running track of the carriages through the drying chamber 1. These outlet openings *3a* are all directed toward the running track. The upper return ducts 3B include a plurality of hot air suction openings *3b* arranged in the direction of carriage movement also. The feed ducts 3A are connected to a feed line 3E which in turn is connected to a blower 3C and a burner 3D. The burner 3D heats the air sent from the blower 3C by combustion, and the feed ducts 3A receive the air heated by the burner 3D. Part of contaminated air may be removed at the burner 3D. The air discharged from the upper return ducts 3B is guided to the blower 3C through a return line 3F. Fresh air may be introduced in a suitable amount into the return line 3F.

Thus, the hot air supplying device 3 causes the hot air to contact the automobile bodies A while flowing upwardly through the drying chamber 1.

Figure 1:
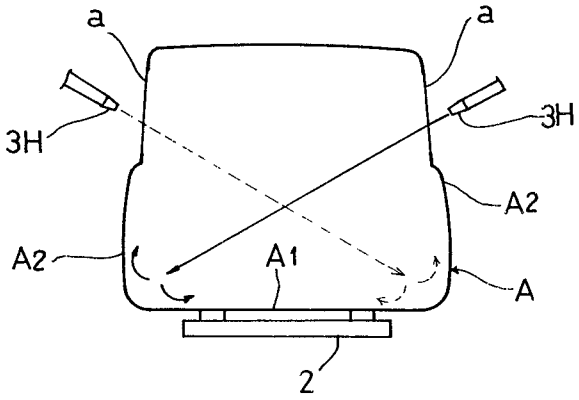

As shown in FIG. 3, this hot air supplying device 3 further includes a second feed line 3G for taking out part of the air heated by the burner 3D. The second feed line 3G is connected to nozzles 3H acting as a second hot air delivery or supplying means arranged at an intermediate position of the drying chamber 1 in the direction of carriage movement. FIG. 1 shows one opposed pair of right and left hot air delivery nozzles 3H provided for drying a body interior by directing hot air to lower inside regions of automobile body A arriving at the intermediate position of the drying chamber 1. As seen, each of the nozzles 3H directs the hot air through an opening or right or left window a of the automobile body A toward an opposite lower inside portion of automobile body A, namely toward an opposite corner between a floor panel A1 and a side panel A2 (which is usually a door panel).

Motor-driven dampers 3J are provided between the second feed line 3G and hot air delivery nozzles 3H for controlling the second hot air supplying means. Each damper 3J has a drive motor M controllable to supply and stop the hot air in response to detections by position detecting sensors 4 comprising, for example, limit switches for contacting the carriage 4 to detect arrival of the automobile body A at the intermediate position of the drying chamber 1. More particularly, the control is effected such that the right and left nozzles 3H deliver the hot air intermittently and alternately when the automobile body A has moved to the intermediate position of the drying chamber 1 with its windows a opposed to the nozzles 3H, and stop deliverying the hot air when the automobile body A moves away from the intermediate position.

According to the above embodiment, the paint applied to the outside surfaces of the automobile body A is heated and dried through contact with the hot air flowing from the downward regions to the upward regions of the drying chamber 1 while the automobile body A advances through the drying chamber 1. The paint applied to the inside surfaces of the automobile body A, inter alia the corners between the side panels A2 and the floor panel A1, is heated and dried by the hot air delivered from the right and left nozzles 3H through the windows a while the automobile body A advances through the intermediate position of the drying chamber 1. Since the automobile body A moves relative to the hot air delivery nozzles 3H, entire areas of the corners may be exposed to the hot air even where the nozzles 3H are the fixed type. Furthermore, since the right and left nozzles 3H deliver the hot air alternately, there occurs no interference between streams of the hot air supplied from right and left. This permits the respective streams to positively act on the right and left corners. Moreover, since the hot air is intermittently delivered from the nozzles 3H, the hot air delivered immediately before each interval spreads in the body interior and heat of heated portions diffuses to adjacent areas by heat transfer during the interval. Consequently, the intermittent delivery of hot air is more effective for a uniform temperature distribution than a continuous delivery.

Figure 5:
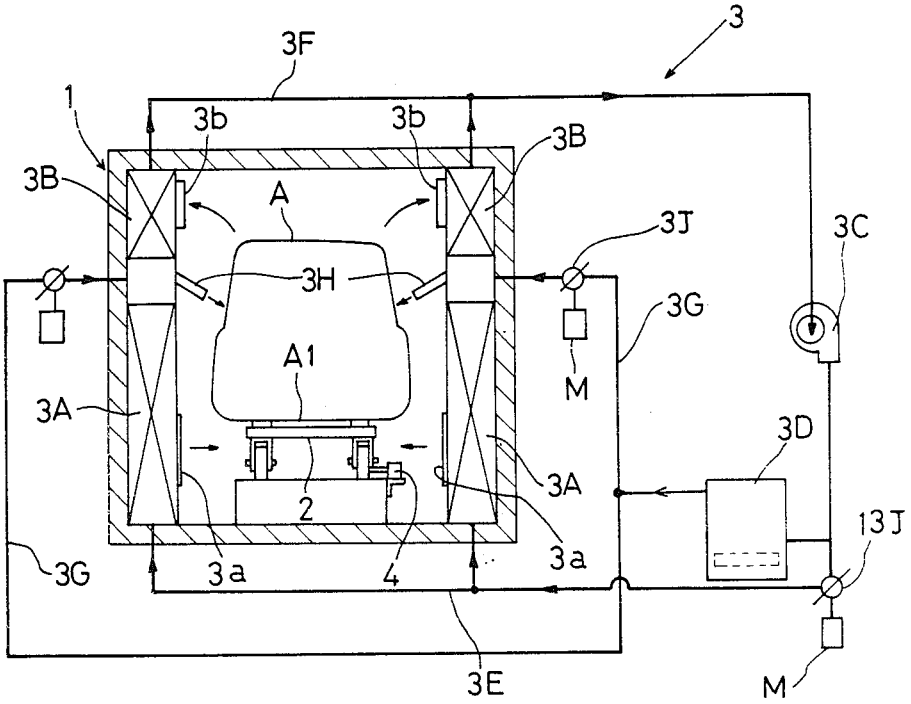
FIG. 5 is a front view in vertical section showing the arrangement of an automobile body in the drying chamber and the hot air supply means according to a further embodiment.

The uniform drying of the inside and outside surfaces of the automobile body A may be carried out more effectively by supplying the air through the air delivery nozzles 3H at a higher temperature than the air supplied through the lower feed ducts 3A. In other words, a temperature difference is provided between the hot air delivered by the nozzles 3H and the hot air delivered through the lower feed ducts 3A which are different means for delivering the hot air from the hot air supplying device 3. The temperature difference should desirably be in the order of 10–300, for example. For this purpose, as shown in FIG. 5, the lower feed ducts 3A may receive the air from the blower 3C by way of a motor-driven damper 13J for taking in cool ambient air in an appropriate amount, bypassing the burner 3D. It will be advantageous in this case if the air leaving the blower 3C is set to a somewhat high temperature in advance. Conversely, as shown in a broken line in FIG. 3, a heater 3K may be provided at an intermediate position of the second feed line 3G which takes out part of the hot air downstream of the burner 3D. The heater 3K can heat the air supplied through the second feed line 3G to the nozzles 3H so that the air from the second hot air supplying means has a temperature higher than the air supplied by the first hot air supply means.

Another embodiment of the invention will be described next.

Figure 4:
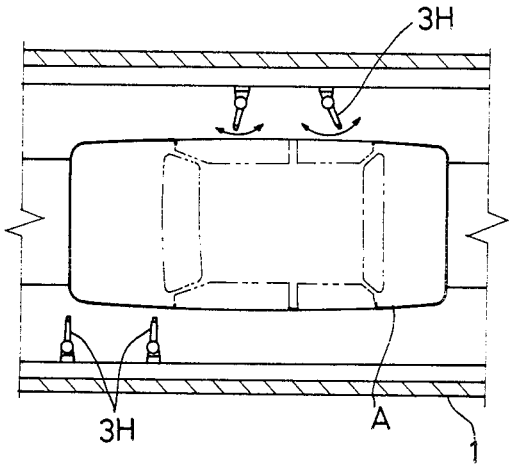
FIG. 4 is a plan view showing a modified arrangement of automobile bodies and hot air supply means in a drying chamber.

In the foregoing embodiments the right and left hot air delivery nozzles 3H are disposed at the same positions with respect to the direction of carriage movement, that is at opposite positions, the right and left nozzles 3H may be staggered in the direction of carriage movement as shown in FIG. 4. The right and left nozzles 3H may be arranged alternately in the direction of carriage movement. Then hot air may be delivered simultaneously from the right and left nozzles 3H without interference between streams of the hot air from the right and left nozzles 3H.

As shown in FIG. 4, the right and left nozzles 3H may be oscillatable on vertical axes to vary directions of hot air delivery. This enables the automobile body A at a standstill to be supplied with the hot air over an enter inside region thereof for uniform heating and drying. Even when the automobile body A is dried while being transported, the hot air may be delivered to substantially the same positions of the automobile interior by varying the directions of hot air delivery in interlocked relationship with the transport means, namely with the movement of the automobile body A. However, when the automobile body A is dried while being transported, the directions of hot air delivery may be varied without regard to the movement of the automobile body A.

Furthermore, where the automobile body A is dried at a standstill, the hot air may be delivered uniformly over the entire interior of the automobile body A by means of a plurality of hot air delivery nozzles 3H instead of varying the directions of hot air delivery. The openings of the automobile body A through which the hot air is delivered may comprise not only the windows but half open doors, and means for delivering the hot air through the windows may comprise other devices than the nozzles.

What is claimed is:

1. A hot air drying system for drying automobile bodies, comprisng a drying apparatus (1) including transport means (2) for transporting the automobile bodies (A) having closed bottoms, and hot air supplying means (3) for supplying hot air into said drying apparatus (1) to heat and dry paint applied to said automobile bodies (A) transported by said transport means (2), wherein said hot air supplying means (3) includes first hot air supplying means for directing the hot air to lower side portions of the automobile bodies (A) thereby drying an outer face of the automobile bodies and second hot air supplying means (3H) for directing the hot air toward inside surfaces of said automobile bodies (A) through openings (a) of said automobile bodies (A), said first and second hot air supplying means being provided to be controllable independently of each other.

2. A hot air drying system as claimed in claim 1 wherein said inside surfaces are lower inside surfaces of said automobile bodies (A).

3. A hot air drying system as claimed in claim 1 wherein said hot air supplying means (3) is operable in interlocked relationship with said transport means (2) for permitting said second hot air supplying means (3H) to deliver the hot air only when said openings (a) of the automobile bodies (A) are opposed to said second hot air supplying means (3H).

4. A hot air drying system as claimed in claim 3 wherein said second hot air supplying means (3H) is arranged at opposite lateral sides of a transporting track of said transport means (2).

5. A hot air drying system as claimed in claim 4 wherein said hot air supplying means (3) is operable to cause said second hot air supplying means (3H) at one lateral side and the other lateral side of the transporting track to deliver the hot air alternately.

6. A hot air drying system as claimed in claim 1 wherein said second hot air supplying means (3H) is movable to vary directions of hot air delivery.

7. A hot air drying system as claimed in claim 6 wherein said second hot air delivery supplying means (3H) is movable to vary the directions of the hot air delivery in interlocked relationship with said transport means (2) to deliver the hot air to substantially the same positions of said automobile bodies (A) in movement.

8. A hot air drying system as claimed in claim 1 wherein said second hot air delivery means (3H) comprises hot air supplying nozzles.

9. A hot air drying system as claimed in claim 1 wherein said openings (a) comprises windows of said automobile bodies (A).

10. A hot air drying system for drying automobile bodies, comprising a drying chamber (1) including transport means (2) for transporting the automobile bodies (A) having closed bottoms, and hot air supplying means (3) for supplying hot air into said drying chamber (1) to heat and dry paint applied to said automobile bodies (A), wherein said hot air supplying means (3) includes second hot air supplying means (3H) for directing the hot air toward lower interior portions of said automobile bodies (A) through openings (a) of said automobile bodies (A), the hot air supplied through said second hot air supplying means (3H) having a higher temperature than the hot air supplied through other means for supplying hot air from said hot air supplying means (3).

11. A hot air drying system as claimed in claim 10 wherein said hot air supplying means (3) includes first hot air supplying means and means provided on a line leading to said first hot air supplying means for taking in air having a low temperature than the hot air delivered by said second hot air supplying means (3H) whereby the hot air delivered by said second hot air supplying means (3H) has a higher temperature other than the hot air delivered by said first hot air supplying means.

12. A hot air drying system as claimed in claim 11 wherein said air intake means comprises a motor-driven damper.

13. A hot air drying system as claimed in claim 11 wherein said first hot air delivery means for delivering the air from said hot air supply means (3) comprises lower feed ducts (3A).

14. A hot air drying system as claimed in claim 10 wherein said second hot air supplying means (3H) comprises hot air delivery nozzles.

15. A hot air drying system as claimed in claim 10 wherein said openings (a) comprises windows of said automobile bodies (A).

16. A hot air drying system for drying automobile bodies, comprising a drying apparatus (1) including transport means (2) for transporting the automobile bodies (A) having closed bottoms, and hot air supplying means (3) for supplying hot air into said drying apparatus (1) to heat and dry paint applied to said automobile bodies (A) transported by said transport means (2), wherein said hot air supplying means (3) includes second hot air supplying means (3H) for directing the hot air toward inside surfaces of said automobile bodies (A) through openings (a) of said automobile bodies (A), with said hot air supplying means operable in interlocked relationship with said transport means (2) for permitting said second hot air supplying means (3H) to deliver the hot air only when said automobile bodies (A) are opposed to said second hot air supplying means (3H), with said second hot air supplying means (3H) arranged at opposite lateral sides of a transporting track of said transport means (2) such that said hot air supplying means (3) is operable to cause said second hot air supplying means (3H) at one lateral side and the other lateral side of the transporting track to deliver the hot air alternately.

17. A hot air drying system for drying automobile bodies, comprising a drying apparatus (1) including transport means (2) for transporting the automobile bodies (A) having closed bottoms, and hot air supplying means (3) for supplying hot air into said drying apparatus (1) to heat and dry paint applied to said automobile bodies (A) transported by said transport means (2), wherein said hot air supplying means (3) includes second hot air supplying means (3H) for directing the hot air toward inside surfaces of said automobile bodies (A) through openings (a) of said automobile bodies (A), with said second hot air supplying means (3H) movable to vary the directions of hot air delivery in interlocked relationship with said transport means (2) to deliver the hot air to substantially the same positions of said automobile bodies (A) in movement.

* * * * *